US010361046B2

(12) United States Patent
Kopp et al.

(10) Patent No.: US 10,361,046 B2
(45) Date of Patent: Jul. 23, 2019

(54) ROTARY AUXILIARY SWITCHES FOR MEDIUM VOLTAGE SWITCHGEARS

(71) Applicant: ABB Schweiz AG, Baden (CH)

(72) Inventors: Dalibor Kopp, Duesseldorf (DE); Robby Zitzmann, Ratingen (DE)

(73) Assignee: ABB SCHWEIZ AG, Baden (CH)

( * ) Notice: Subject to any disclaimer, the term of this patent is extended or adjusted under 35 U.S.C. 154(b) by 216 days.

(21) Appl. No.: 15/371,247

(22) Filed: Dec. 7, 2016

(65) Prior Publication Data

US 2017/0169969 A1 Jun. 15, 2017

(30) Foreign Application Priority Data

Dec. 10, 2015 (EP) ..... 15199423

(51) Int. Cl.

| | |
|---|---|
| ***H01H 19/14*** | (2006.01) |
| ***H01H 3/42*** | (2006.01) |
| ***H01H 19/03*** | (2006.01) |
| *H01H 3/46* | (2006.01) |

(52) U.S. Cl.

CPC ..... *H01H 19/14* (2013.01); *H01H 3/42* (2013.01); *H01H 19/03* (2013.01); *H01H 3/46* (2013.01)

(58) Field of Classification Search

CPC ..... H01H 19/14; H01H 3/42; H01H 19/03; H01H 3/46

See application file for complete search history.

(56) References Cited

U.S. PATENT DOCUMENTS

| | | | | | |
|---|---|---|---|---|---|
| 2,621,395 | A * | 12/1952 | Miller | B23Q 5/52 | 29/41 |
| 4,924,724 | A * | 5/1990 | Yoshimura | B63H 21/213 | 192/21 |
| 4,926,707 | A * | 5/1990 | Yamada | E05B 81/06 | 292/201 |
| 5,475,190 | A * | 12/1995 | Smith | H01H 3/26 | 200/17 R |
| 2005/0241928 | A1* | 11/2005 | McCord | H01H 3/3031 | 200/400 |
| 2010/0089875 | A1* | 4/2010 | Treier | H01H 31/003 | 218/154 |
| 2014/0240066 | A1* | 8/2014 | Gerovac | H01H 3/56 | 335/228 |

(Continued)

FOREIGN PATENT DOCUMENTS

| | | | |
|---|---|---|---|
| AU | 633425 | B2 | 1/1993 |
| CN | 1056183 | A | 11/1991 |
| CN | 1264907 | A | 8/2000 |

(Continued)

*Primary Examiner* — Zakaria Elahmadi

(74) *Attorney, Agent, or Firm* — Leydig, Voit & Mayer, Ltd.

(57) ABSTRACT

A rotary auxiliary switch for medium voltage switchgears, has a lever with a cam track, along which a driving element is movable. In order to cause the lever to be covered in such a way, the operator cannot touch the application, such that the lever is split into two complementarily lever components the two components creating a hinge, when they are mechanically mounted, the resulting cam track also being splitted into two cam track parts, such that a partly first cam track is located in the first lever component, and the partly second cam track is located in the second lever component.

6 Claims, 4 Drawing Sheets

(56) References Cited

U.S. PATENT DOCUMENTS

2018/0025868 A1* 1/2018 Terada ..... H01H 33/42
218/154

FOREIGN PATENT DOCUMENTS

| | | | |
|---|---|---|---|
| CN | 201289976 | Y | 8/2009 |
| CN | 101752133 | A | 6/2010 |
| JP | H 10134679 | A | 5/1998 |
| TW | 379845 | U | 1/2000 |

* cited by examiner

ROTARY AUXILIARY SWITCHES FOR MEDIUM VOLTAGE SWITCHGEARS

CROSS-REFERENCE TO RELATED APPLICATIONS

Priority is claimed to European Patent Application No. 15 199 423.3, filed on Dec. 10, 2015, the entire disclosure of which is hereby incorporated by reference herein.

FIELD

The invention relates to a rotary auxiliary switch for medium voltage switchgears.

BACKGROUND

Rotary auxiliary switches are a version of auxiliary switches which are forced/actuated by a rotary actuation. The demand for an auxiliary switch application is, that the switch is positively driven. That means that in all positions, the auxiliary switch cannot change the position due to external forces, which are not based on the application. State of the art is, to actuate a rotary auxiliary switch with a lever with a cam track. This lever provides the positively driven situation because the position is related to the driving element only.

By moving of a pin in the cam track, the lever turns around an axis of the rotary auxiliary switch from one position to another position. The function is to transfer a continuous movement to a discontinuous movement.

By that known construction, a disadvantage is, that in its end positions, the system needs the space for the lever which has a big impact in the used volume, where the application is installed. The space cannot be used for other equipment installtions, for example electronic components.

SUMMARY

An aspect of the invention provides a rotary auxiliary switch for medium voltage switchgears, the switch comprising: a lever including a cam track, along which a driving element is movable, wherein, by moving a pin in the cam track, the lever turns around an axis of the rotary auxiliary switch from one position to another position, to thereby transfer a continuous movement to a discontinuous movement, wherein the lever is split into complementarily first and second lever components such that the first and second lever components create a hinge, when the first and second lever components are mechanically mounted, and wherein a resulting cam track is also split into first and second cam track parts such that the first cam track part is located in the first lever component, and the second cam track part is located in the second lever component.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

So it is an aspect of the invention, that the lever has to be covered in such a way, that the operator cannot touch the application.

Problems mentioned in the Background are solved by the invention. An aspect of the invention relates to a rotary auxiliary switch for medium voltage switchgears, with a lever with a cam track, along which a driving element is movable.

An aspect of the invention is, that the lever is split into two complementarily lever components (a, b) in such, that the two components create a hinge, when they are mechanically mounted, and that the resulting cam track is also splitted into two cam track parts, in such, that a partly first cam track which is located in the first lever component (a), and the partly second cam track is located in the second lever component (b).

That means, for a rotary auxiliary switch for medium voltage switchgears, the lever is split into two components with a hinge in its connecting point. Together with a guide line on a base plate and or a cover the actuation lever is fold in its end position in that way that demanded volume is bisected. By using the guide lines a forced driven application is still ensured. By using this application it is possible to decrease the size of the application.

In one further advantageous embodiment, the cam track in the first lever component (a) is devided into two serial sections of line, which are arranged in an angle, and that the centerpoint of the angle is the arranged in the centerpoint of the resulting hinge.

In a further advantageous embodiment, the one cam track section ends in the first lever component (a), and the second cam track section ends open in the circumferential of the first lever component (a).

Further advantageous is that the first lever component (a) is provided at that end, which results in the aforesaid hinge, with a flat round section, and that the second lever component (b) is provided in the resulting region of the aforesaid hinge, with a flat ring, which is dimensioned as such, that this ring at least partly surrounds the flat round section of the first lever component (a).

A further important and advantageous embodiment is, that the flat ring section of the second lever component is provided with integrated end position stopper, which limits the angular movement of the hinge, that means, that it limits the first lever components pivoting movement in the second lever component.

Figure 1:
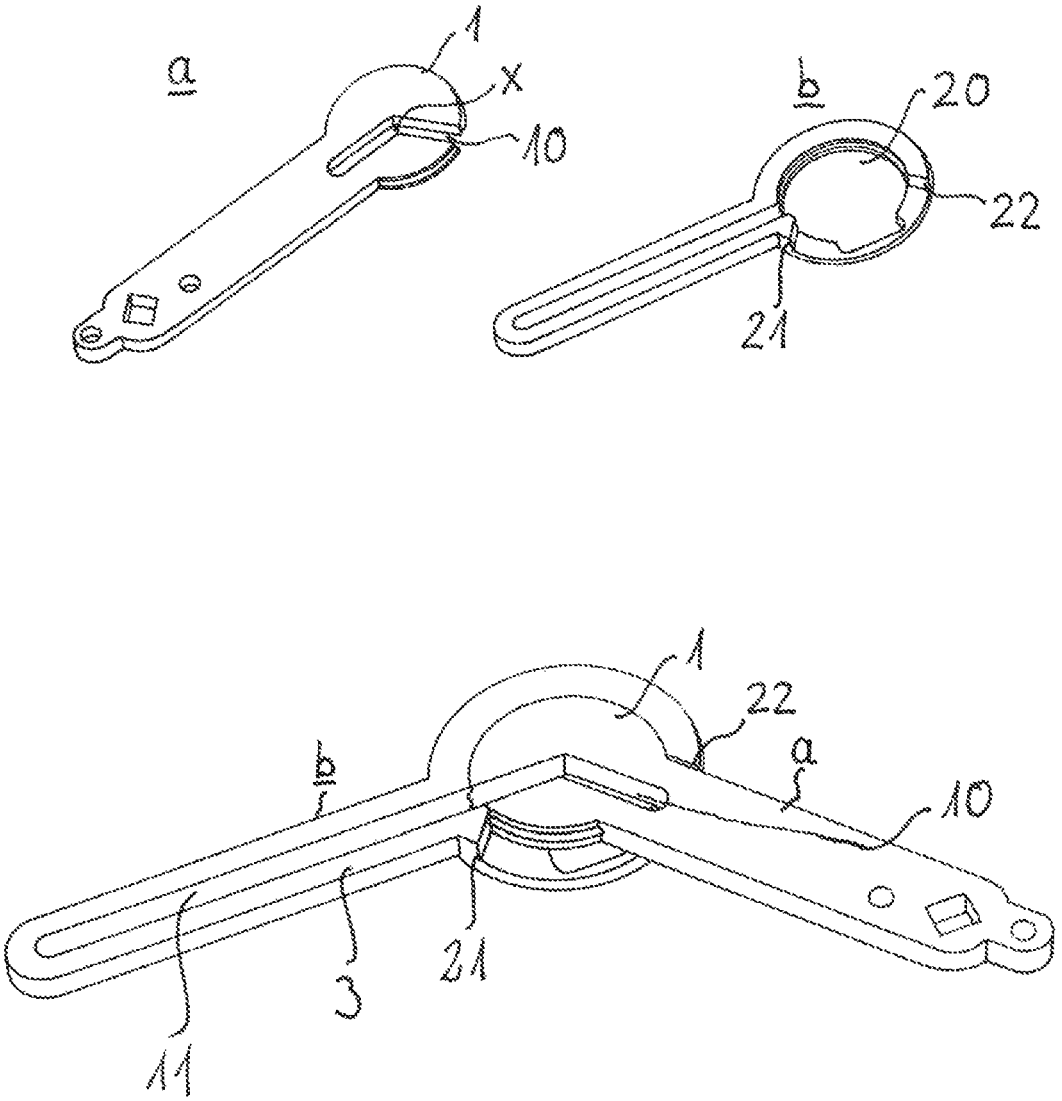
FIG. 1 two component lever.

According to the invention, the lever is split into two component a and b, which are designed complementarily. The upper part of FIG. 1 shows the two components "a" and "b", The first component a is designed as a long strip, with an extended round portion 1 at one end. This round portion 1 is already one part of the resulting hinge, after component "a" and component "b" are matched together.

Inside the round portion 1 is implemented a part of the resulting cam track 10. The two cam tracks are merging together in the central point x of the round portion 1, in an angle of for example 130°.

The second component b of the lever has also portion as a long strip 3, and a circumferential ring 2 at one end. The resulting opening 20 of that ring 2 of component "b" is dimensioned as such, that the round portion 1 of the first component "a" can be layed into that, by resulting a hinge. The component "b" is also provided with a cam track 11, formed as a linear slot, which ends at the edge of the aforesaid ring.

The lower part of FIG. 1 shows both components "a" and "b" after assembling. The pivot angle of the first component a in the second component "b" is limited by two rotation limiters, in an angle of round about 130°. At one rotational end position, the cam track of the first component a is led into the cam track of the second component b of the lever.

Figure 2:
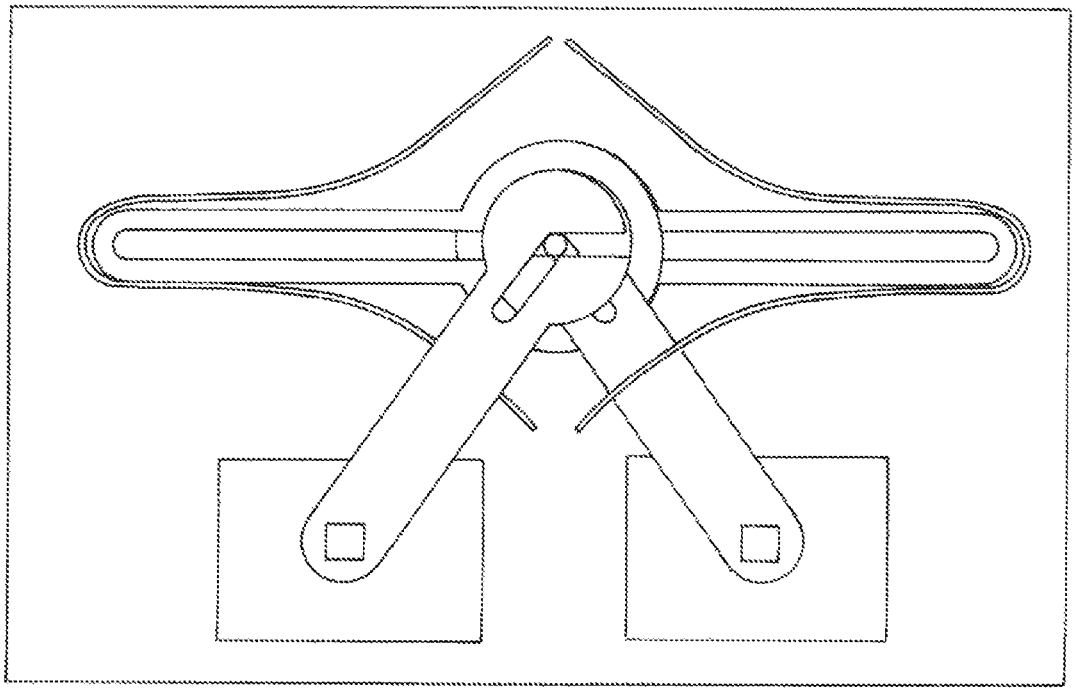
FIG. 2 lever in function, position 1.

FIG. 2 shows an emdodiment with two auxiliary switches, by the use of two aforesaid levers, which are coupled by a common driving element, formed as a movable pin, which accesses into the resulting cam track of each liver.

The position is used for indicate disconnector OFF position and a ground OFF position. Each auxiliary switch is used for one switch. Both auxiliary switches are in zero position, for example 0°.

Figure 3:
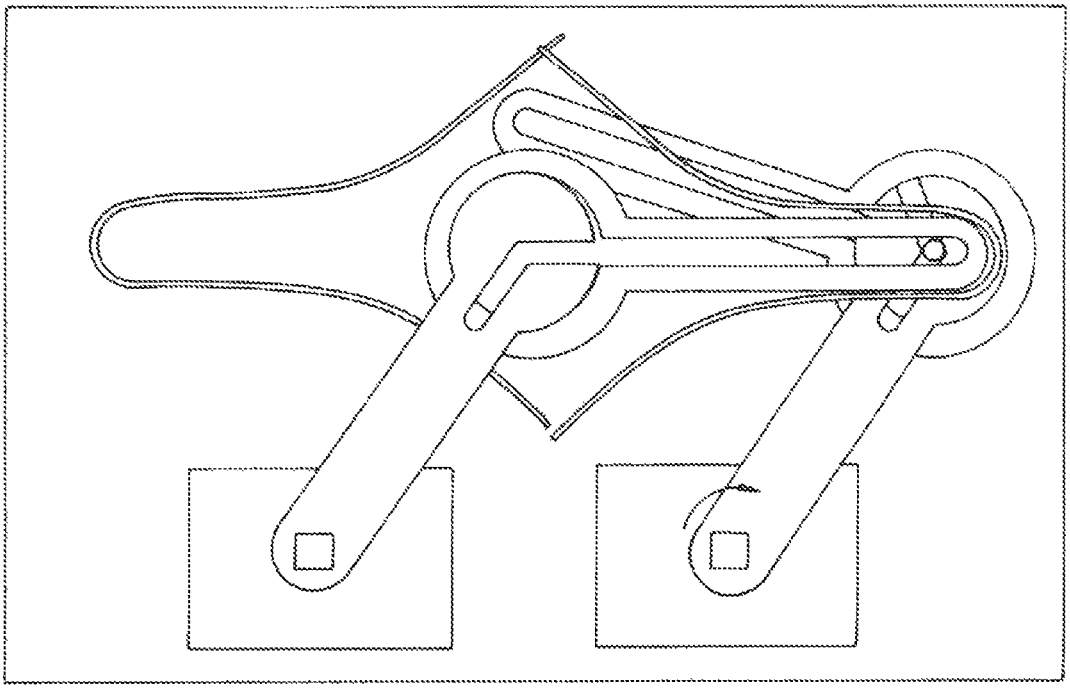
FIG. 3 lever in function, position 2.

FIG. 3 shows a further position, by the use of two auxiliary switches in a further switching position.

The lever, or better said, each first component a of each resulting lever is provided with a inner key surface at one end, and the concerning auxiliary switch with an outer key surface, in such, that each auxiliary switch can mechanically be coupled with the concerning lever. Each concerning lever is then pivotable around the rotation axis of the concerning auxiliary switch. The driving element or driving pin is dimensioned as long enough, to run in the cam track of the both levers. FIG. 3 therefore shows a further possible position.

One position is driven by the application by an defined angle to indicates the changed position and give the correct signals for the end position, for example switch ON.

Figure 4:
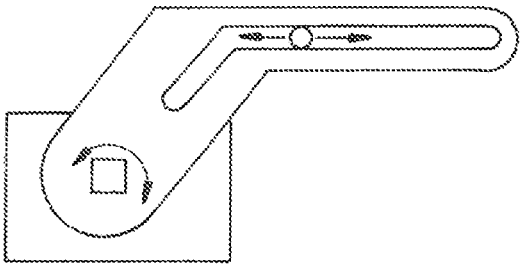
PRIOR ART Fig.4
FIG. 4 a well known construction of the state of the art.
Figure 5:
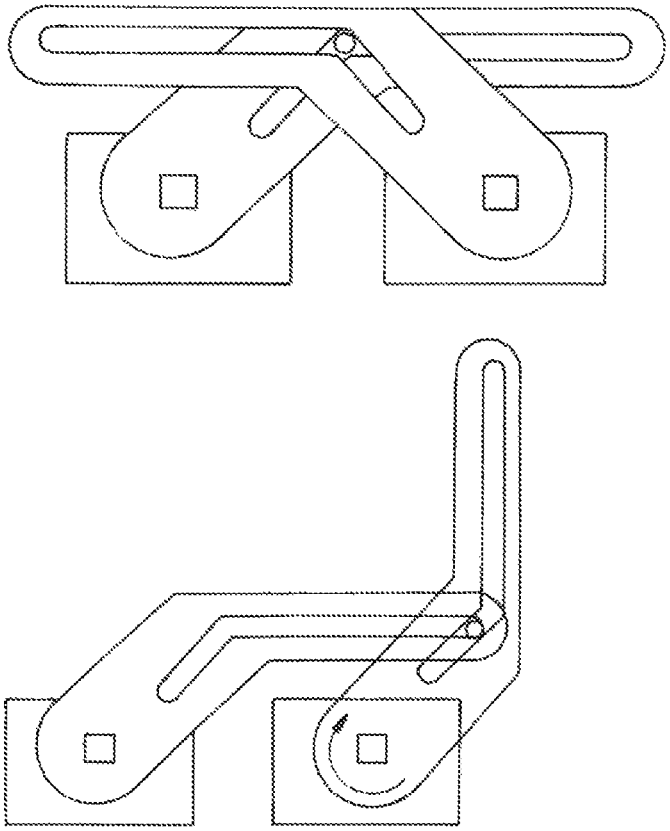
PRIOR ART Fig.5
FIG. 5 a well known construction of the state of the art.

FIGS. 4 and 5 are diplaying well known constructions of the state of the art. There are used one piece levers, without the resulting hinge of the above described invention. It is easy to see, that the functionality of such a well known lever from the state of the art is dramatically reduced.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B, and C" should be interpreted as one or more of a group of elements consisting of A, B, and C, and should not be interpreted as requiring at least one of each of the listed elements A, B, and C, regardless of whether A, B, and C are related as categories or otherwise. Moreover, the recitation of "A, B, and/or C" or "at least one of A, B, or C" should be interpreted as including any singular entity from the listed elements, e.g., A, any subset from the listed elements, e.g., A and B, or the entire list of elements A, B, and C.

NUMBERING a component of the lever
b component of the lever
1 round portion
2 circumferrential ring
3 long strip
10 cam track
11 cam track
20 open ring
21,22 rotation limiters

The invention claimed is:

1. A rotary auxiliary switch for medium voltage switchgears, the switch comprising:

a lever including a cam track, along which a driving element is movable, wherein, by moving a pin in the cam track, the lever turns around an axis of the rotary auxiliary switch from one position to another position, to thereby transfer a continuous movement to a discontinuous movement, wherein the lever is split into complementary first and second lever components such that the first and second lever components create a hinge when the first and second lever components are mechanically mounted, wherein the cam track is split into first and second cam track parts such that the first cam track part is located in the first lever component and the second cam track part is located in the second lever component, wherein the first lever component includes at an end, resulting in the hinge, a flat round section, and wherein the second lever component includes, in a resulting region of the hinge, a flat ring, the flat ring being dimensioned such that the flat ring at least partly surrounds the flat round section of the first lever component.

2. The switch of claim 1, wherein the first cam track part is divided into two serial sections of line, which are arranged in an angle, and wherein a center point of the angle corresponds to a center point of the hinge.

3. The switch of claim 2, wherein one section of the cam track ends in the first lever component, and wherein a second section of the cam track opens circumferentially to the first lever component.

4. The switch of claim 1, wherein the flat ring of the second lever component includes an integrated end position stopper, wherein the integrated end position stopper limits an angular movement of the hinge, such that the integrated end position stopper limits a pivoting movement of the first lever component in the second lever component.

5. The switch of claim 2, wherein the flat ring of the second lever component includes an integrated end position stopper, wherein the integrated end position stopper limits an angular movement of the hinge, such that the integrated end position stopper limits a pivoting movement of the first lever component in the second lever component.

6. The switch of claim 3, wherein the flat ring of the second lever component includes an integrated end position stopper, wherein the integrated end position stopper limits an angular movement of the hinge, such that the integrated end position stopper limits a pivoting movement of the first lever component in the second lever component.

* * * * *